United States Patent [19]

Little et al.

[11] 4,142,167

[45] Feb. 27, 1979

[54] SOLENOID OPERATED, OPPOSITELY ROTATED ACTUATOR

[75] Inventors: Carl H. Little, Jamestown, N.Y.; W. Rex Deshaw, Sparta, Mich.

[73] Assignee: Keeler Corporation, Grand Rapids, Mich.

[21] Appl. No.: 839,930

[22] Filed: Oct. 6, 1977

[51] Int. Cl.[2] ..... H01H 3/42

[52] U.S. Cl. ..... 335/190; 70/264; 200/27 R

[58] Field of Search ..... 335/190, 188, 73, 74, 335/75; 200/27 R, 21, 23, 24, 26; 70/264; 292/144, 169.11; 74/54, 55, 59, 99

[56] References Cited

U.S. PATENT DOCUMENTS

| | | | |
|---|---|---|---|
| 3,062,034 | 11/1962 | Leslie | 70/264 |
| 3,200,657 | 8/1965 | Barden et al. | 74/99 |
| 4,003,010 | 1/1977 | Kuchuris | 335/190 |

*Primary Examiner*—Harold Broome

*Attorney, Agent, or Firm*—Price, Heneveld, Huizenga & Cooper

[57] ABSTRACT

An actuator for converting linear motion to alternating, opposite direction, rotary motion. The actuator is electrically operated and selectively activatable to produce rotary motion in a desired direction via separately incorporated electrical circuits. Included is an electric solenoid operated plunger which reciprocates a rotatable cam. The cam both drives a rotatable pivot member in alternating, opposite directions via cam followers and completes one or the other of two electrical circuits depending on the rotational position of the pivot member. The solenoid is activatable to produce rotational motion in a desired direction only if the cam is completing the appropriate electrical circuit. The cam is supported by a housing and is positioned for re-engagement with one of the pivot member cam followers by the housing after each stroke of the solenoid.

27 Claims, 13 Drawing Figures

LOCK
UNLOCK

SOLENOID OPERATED, OPPOSITELY ROTATED ACTUATOR

BACKGROUND OF THE INVENTION

This invention relates to an actuator for converting rectilinear motion to alternating, opposite direction, rotary motion and, more particularly, to such an actuator adapted for use in actuating mechanisms such as automobile door locks and the like.

Many mechanical devices require the provision of positive, rotational motion alternating in opposite directions. It is desirable that such motion be produced as demanded without constant operation or energy use. One way to accomplish that result is to convert reciprocal motion to alternating, opposite direction, rotary motion utilizing a reciprocal camming element operating a pivot member and many prior devices have been developed for such purposes. However, many of the prior devices included complex, intricate mechanisms which could not reliably or positively reposition the camming element for subsequent operation without contact with the pivot member. This subjected the pivot member to wear and allowed unintended motion of the pivot member. Also, the camming element and pivot member were often not reliably and securely supported and were subject to wear and frequent breakdown.

Such alternating rotational motion has been found especially useful for remote operation of vehicle door locks. A particular objective with such locks is to either lock or unlock a door by operation of the actuator mechanisms in the desired, predetermined direction only if the door is not already locked or unlocked. The actuator should not operate to unlock the door if the door is already locked unless the operator deliberately chooses to operate the actuator in the "unlock" direction and vice-versa. However, the prior devices failed to provide these features and especially the positive rotational actuation in only a desired direction upon demand. The prior devices generally failed to provide any indication of, or control over, the direction of rotational movement. In addition, the particular application to door lock mechanisms requires the ability to operate safely in a confined space while overcoming the drawbacks and providing the features mentioned.

SUMMARY OF THE INVENTION

Accordingly, the present invention provides an actuator for converting linear motion to alternating, opposite direction, rotary motion. The present actuator is especially adapted for use in actuating vehicle door lock mechanisms. The actuator is electrically operated and is selectively activatable to produce rotary motion only in a desired direction via separate electrical circuits included therein.

In one aspect, the actuator includes a pivot member and means for rotatably mounting the pivot member. A reciprocable camming means alternately rotates the pivot member in opposite rotational directions. The pivot member includes a pair of contact members mounted thereon and electrically insulated from one another while the camming means includes electrical contact means for engaging the contact members. The electrical contact means engage one of the contact members in one of the positions of the pivot member and the other contact member in the other position thereof. Thus, two separate and distinct electrical paths are provided through the camming means and pivot member depending on the rotational position of the pivot member.

In another aspect, the actuator camming means includes a camming member and electrically operated means for rotatably mounting and reciprocating the camming member. The pivot member includes spaced, cam follower means which are alternately engaged by the camming member during reciprocation to rotate the pivot member in opposite directions. Preferably, electrical operation of the camming member is provided by an electric solenoid.

In yet other aspects of the invention, a unique actuator housing is provided which includes a surface for slidably supporting the camming member. The housing also includes engaging means which automatically reposition the camming member for engagement with one of the cam followers on the pivot member during the next reciprocation of the camming member. No contact with the pivot member is necessary to reposition the camming member.

The present actuator provides numerous advantages over prior known actuators. First, the overall assembly is simply designed for a reliable operation over a long period of time. The camming member both provides alternating rotational action and forms an electrical connection between one of two electrical circuits contained in the actuator. Further, switching between the two circuits occurs only when the electric solenoid is de-energized preventing any danger of sparking or arcing. This is particularly important when the actuator is used in small, closed areas such as in the door or interior of a vehicle body to prevent the danger of fire or explosion. Also, the solenoid itself is uniquely designed for maximum magnetic force.

These and other objects, advantages, purposes and features of the invention will become more apparent from a study of the following description taken in conjunction with the drawings.

DESCRIPTION OF THE PREFERRED EMBODIMENT

Figures 1, 2, 3, 4, 5, 12:
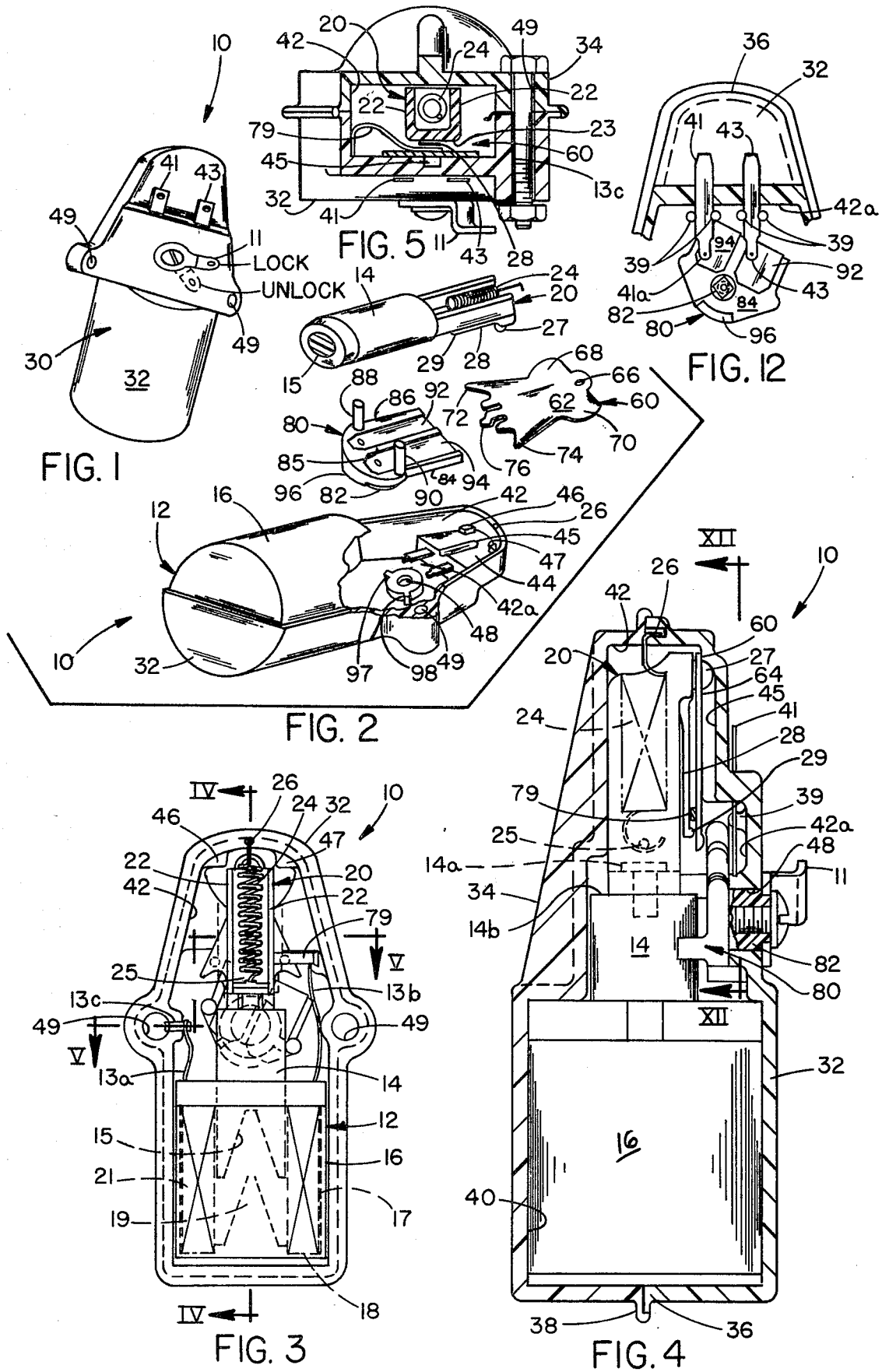
FIG. 1 is an exterior perspective view of the actuator of the present invention.
FIG. 2 is an exploded perspective view of the actuator shown in FIG. 1 with portions broken away to reveal the interior of one half of the housing for the actuator.
FIG. 3 is a plan view of the actuator with the top housing half removed.
FIG. 4 is an enlarged sectional side elevation of the actuator taken along plane IV—IV of FIG. 3.
FIG. 5 is a sectional end elevation of the actuator taken along line V—V of FIG. 3.
FIG. 12 is a fragmentary sectional view of the rear surface of the pivot member and the electrical contacts therefore taken along plane XII—XII of FIG. 4.
Figure 6:
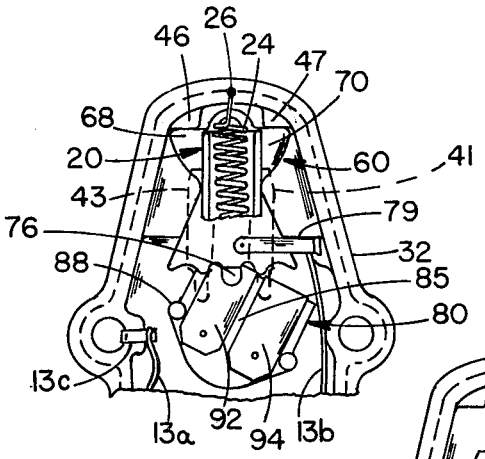
FIG. 6 is a fragmentary plan view of the actuator interior shown at the beginning of one of the reciprocal strokes of the plunger and camming plate therein.

Referring now to the drawings in greater detail, FIGS. 1 and 2 illustrate the actuator 10 of the present invention which converts linear motion to alternating, opposite direction, rotary motion when an electric solenoid 12 is activated and energized by moving an appropriate switch. The actuator 10 is designed for use especially in vehicle doorlock systems for remote locking of door latch mechanisms of the vehicle when a switch is thrown. The actuator includes a cylindrical, electric solenoid 12 which reciprocates a plunger 20 rigidly secured to the reciprocating central member 14 of the solenoid (FIGS. 3 & 4). The plunger 20 correspondingly reciprocates a camming plate 60 for engagement with and rotation of pivot member 80. Camming plate 60 is slidably supported on a surface within housing half 32 of housing 30, while pivot 80 is separately rotatably supported on that same housing half at a position offset from the plane of the camming plate. An actuator lever or crank 11, designed for attachment to a door latch or other mechanism to be operated, is secured to an axle extending through housing half 32 from pivot 80. After rotation of pivot member 80, and during return of plunger 20 to its beginning position, camming plate 60 changes electrical contact between one or the other of two electrical paths or circuits provided through the assembly. Such separate electrical circuits enable rotation of pivot member 80 in the desired direction depending on the rotational position of the pivot member when actuation of the solenoid is attempted.

As is best seen in FIGS. 2 through 5, housing 30. which encloses and protects the operational elements of the actuator, includes two halves, 32, 34 each of which is molded from a thermo-plastic material such as polycarbonate or Delrin (T.M. of DuPont Corp.) or Celcon (T.M. Celenese Corp.) acetal resin. The housing halves include appropriate pockets, recesses, surfaces, projections and slots or apertures to enable receipt, mounting and operation of the various elements described hereinafter. When the elements are assembled within the housing, the two housing halves are fitted together with a peripheral edge flange 36 of housing half 32 received within peripheral edge flange 38 of housing half 34 (FIG. 4). Flanges 36, 38 are ultrasonically welded or otherwise sealed together to permanently encase the actuator elements. This prevents dirt or dust from entering the housing and prevents excape of any sparks or arcing which might occur.

Housing 30 includes a pocket or recess 40 (FIG. 4) receiving a cylindrical solenoid 12. An extension 42 of pocket 40 receives the remainder of the operational elements. At the closed end of pocket extension 42 is provided a sliding surface 44 (FIG. 2) for slidably supporting camming plate 60. Surface 44 includes a rectilinear, recessed slot 45 which guides the reciprocation of the plunger and camming plate as explained hereinafter. Shoulders or projecting abutments 46, 47 extend upwardly from surface 44 and outwardly from the closed end of extension 42 for engagement by portions of the camming plate to center and reposition the same as will also be explained hereinafter. An aperture 48 is provided in portion 42*a* of housing half 32 through which the axle of pivot member 80 extends for engagement with crank 11 to actuate the desired door lock mechanism or other device. In addition, as shown in FIGS. 1–3 and 5, attaching bolt mounting holes 49 are provided on either side of the housing for receiving bolts for attachment of the actuator 10 to a support within a vehicle or to another mechanism.

Housing half 32 supports electrical input contact members 41, 43 (FIGS. 1, 4 and 12) which extend through a wall of that housing half into portion 42*a* of the housing interior. These contact members are supported between upstanding projections 39 at space positions within the housing portion 42*a* and extend outwardly of the housing for connection to leads from a source of electrical energy such as an automobile battery or the like. Contacts 41, 43 include contact ends 41*a*, 43*a* (FIG. 12), which engage electrical contact members 92, 94 on the rear surface of pivot 80 as will be described hereinafter. Contacts 41, 43 are preferably formed from flexible, resilient electrically conductive metal such as phosphor bronze or the like.

As shown in FIGS. 2 through 4, solenoid 12 includes a hollow cylindrical body 16 including an outer, metallic cylindrical frame having sides 17 and a bottom 18 which is continuous in one-piece with sides 17. A conical, upwardly projecting core 19 is formed in one piece with bottom 18. The outer frame is made from mild steel, annealed to enhance magnetic qualities. Wound within the cylindrical sides 17 of the frames is a length of magnet wire, preferably 80 feet of No. 20 wire, to form a coil 21 which preferably draws 14 amperes of electrical current from a 12 volt DC source. The center of coil 21 forms an open cylindrical passageway receiving central reciprocal member 14. Central member 14 includes a conical recess 15 matching the shape and contour of core 19 such that the central member may be magnetically pulled and received entirely within the body 16 of the solenoid when coil 21 is energized. The one-piece frame including sides 17, bottom 18 and the uniquely configured core 19 is designed to efficiently convey and conduct magnetic flux so that the lines of magnetic force are directed toward central member 14 for maximum magnetic force. Thus, bottom 18 serves as both support for the core 19 and the bottom of the magnetic leakage path which extends around the entire coil 21.

A ground lead 13*a* from solenoid 12 leads to an elongated, leaf spring conductor 13*c* extending through a portion of one of the securing bolt holes 49 (see Figures 3 and 5). Engagement between conductor 13*c* and a securing bolt extending through aperture 49 grounds actuator 10 to the vehicle body or other device on which the actuator is mounted. A power lead 13*b* extends from the other side of coil 21 of solenoid 12 into contact with a spring-like electrical conductor or contact member 79 which slidingly engages camming plate 60 as will be described hereinafter.

As seen in FIGS. 2 and 5, a molded, thermoplastic, channel-like plunger 20 is rigidly secured by rivet 14*a* to the end surface 14*b* of central member 14 opposite the end in which recess 15 is formed. Plunger 20 includes channel sides 22 and a channel bottom 23 forming an elongated channel opening receiving coil biasing spring 24. One end of coil spring 24 is received around pin 25 at the end of plunger 20 closest to solenoid 12 while the other end is secured in an aperture 26 at the end of housing half 32 opposite from the solenoid. When solenoid 12 is activated, plunger 20 and central member 14 are moved together against the biasing force of spring 24. When the electrical energy is shut off, the biasing force of the spring acting on pin 25 returns plunger 20 and central member 14 toward the end of extension space 42 into position for another reciprocal stroke.

Plunger 20 also includes a projection 27 having an hemispherical head and corresponding in width to that of slot 45 in support surface 44 of housing half 32. When solenoid 12 is received in the housing, slot 45 is parallel to the direction of reciprocation of plunger 20 and central member 14 and the receipt of projection 27 therein helps guide the reciprocal motion of those portions.

An elongated, camming plate biasing member 28 is formed in one piece with bottom 23 of plunger 20. Biasing member 28 extends in a cantilevered fashion from bottom 23 such that it extends rearwardly toward the solenoid 12 and away from the end of recess 42. Biasing member 28 ends in a rounded projection 29 which slidingly engages the top surface of camming plate 60 to urge it against support surface 44 and into engagement with pivot member 80 as will be more fully explained hereinafter.

As is best seen in FIGS. 2, 3 and 6–11, a generally planar camming plate 60 preferably formed from brass sheet metal is slidably supported on support surface 44 within space 42 of housing half 32 and engaged by projection 27 of plunger 20. Top surface 62 of camming plate 60 is slidably engaged by projection 29 of biasing member 28 while the opposite planar surface of the camming plate 64 slides on surface 44. Plate 60 includes a circular aperture 66 which is fitted over projection 27 such that plate 60 can rotate with respect to the projection and plunger. Adjacent, and on either side of aperture 66, are wing-like extensions 68, 70 having edges adapted for engagement with projections 46, 47 within housing half 32 to center the plate 60 upon return to its beginning position in preparation for another reciprocal stroke. Plate 60 also includes wing-like camming projections 72, 74 having recessed, curved camming edges facing in a direction opposite to the edges of extension 68, 70. Projections 72, 74 alternately engage cam follower posts 88, 90 on pivot member 80. Also, plate 60 includes an electrical contact foot 76 intermediate camming projections 72, 74 which is adapted to slide over the surface of pivot member 80.

A curved electrical contact 79, which is electrically secured to lead 13*b* from solenoid 12 and fitted within a slot formed therefor in the side of housing half 32, extends under plunger 20, biasing member 28 and into contact with top surface 62 of camming plate 60. Contact 79 is preferably formed from electrically conductive phosphor bronze or, alternately, hard brass. Contact 79 has sufficient resiliency to maintain positive sliding contact with the surface of camming plate 60 throughout operation of the actuator.

Pivot member 80 is rotatably secured through aperture 48 in housing half 32 by means of an integral axle 82 extending from the rear surface 84 of pivot member 80 as Shown in FIGS. 2, 4 and 12. Extending outwardly from the opposite surface 86 of pivot member 80 are cylindrical, cam follower posts 88, 90 which are alternately engaged by the edges of camming projections 72, 74 on plate 60. Camming posts 88, 90 are adjacent the extreme lateral outside edges of pivot member 80 to provide sufficient torque to rotate member 80 within aperture 48 about axle 82. In addition, the space between posts 88, 90 is sufficient to allow passage of the extension 72, 74 of plate 60, but only when the plate is rotated to one side or the other as will be explained below. Pivot member 80 is formed from a suitable dielectric material such as Delrin (T.M. of DuPont Corp.) acetal homopolymer and receives two, spaced, U-shaped electrical contact members 92, 94 which extend from the front surface 86 over the top edge of the pivot member along the rear surface 84 thereof. These contacts are recessed in at surface 86 so that a flush surface with the dielectric strip 85 extending therebetween is provided. Contacts 41, 43 slidably engage contact 92, 94 on the rear surface 84, while foot 76 of camming plate 60 slidably engages one or the other of these contact members on the front surface 86 of pivot member 80. Accordingly, depending on which contact plate 92, 94 is engaged by foot 76, one of two electrical circuits will be completed through the actuator for energization of the solenoid 12.

Pivot member 80 also includes a stop or abutment 96 (FIGS. 2 & 12) which engages shoulders or abutments 97, 98 (FIG. 2) extending radially from the edge of aperture 48 within housing half 32 to limit pivotal movement of the member. Also, the end of axle 82 projects out of housing 30 and has a non-circular or square outline which engages a corresponding aperture in crank 11 to prevent rotation of the crank with respect to the pivot member axle during rotation. As will be seen, the position of pivot member 80 in the housing is offset from that of both plunger 20 and cam plate 60 such that camming plate 60 is intermediate the plunger and the pivot member. Rotation of pivot member 80 about axle 82 is generally in a plane such that foot 76 will always be in contact with one or the other of the contacts 92, 94.

Referring now to FIGS. 6–11, operation of the actuator will be understood. With the solenoid 12 de-energized, biasing spring 24 urges plunger 20, central member 14 and thus, camming plate 60 toward the closed end of extension space 42 of the housing. Projections 68, 70 engage shoulders 46, 47 to rotate and center the plate. At this time, pivot member may be either in its left or right-hand rotated position, the left-hand rotation position being shown in FIG. 6. A switch is thrown in the electrical line leading to electric contact 43 and electricity is conducted through contact 43 to conductor 92 via contact end 43*a*. Since foot 76 of camming plate 60 is engaged with the opposite side of conductor 92, electricity travels through foot 76, camming plate 60, contact 79 and wire lead 13*b* to solenoid 12. The circuit is completed through the ground contact 13*c* and wire lead 13*a*.

Figure 7:
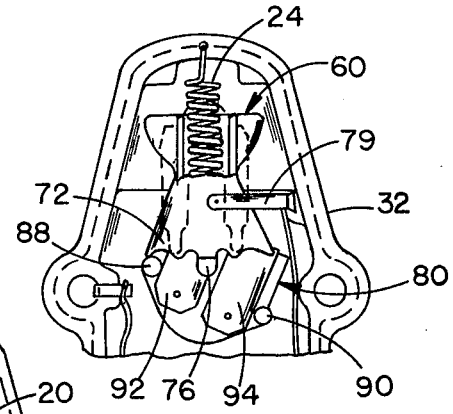
FIG. 7 is a fragmentary plan view of the actuator illustrating an intermediate position during the reciprocal stroke wherein one camming edge of the camming plate is contacting one of the cam follower posts of the pivot member.

Once energized, central member 14 is withdrawn into the air space in coil 21 simultaneously moving plunger 20 and camming plate 60 toward pivot member 80 as shown in FIG. 7. Since the camming plate 60 is centered, the outer portion of camming wing 72 engages cam follower post 88. Foot 76 of camming plate 60 remains in contact with a portion of conductor 92 maintaining operation of the solenoid.

Figure 9:
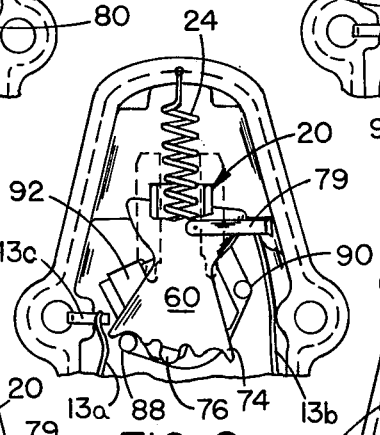
FIG. 9 is a fragmentary plan view of the actuator interior with the plunger fully retracted and the camming plate having fully pivoted the pivot member in one direction to the unlocked position.
Figure 8:
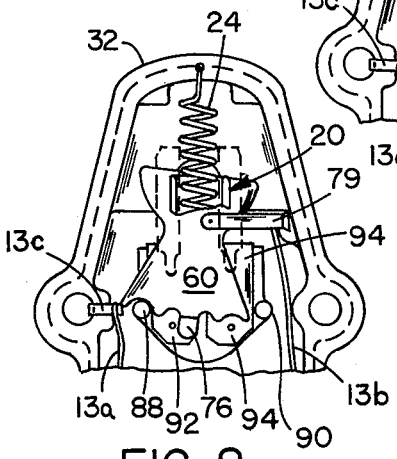
FIG. 8 is a fragmentary plan view of the actuator interior illustrating a second intermediate position during the reciprocal stroke wherein the camming plate is fully engaged with one post of the pivot member and has begun rotation of the pivot member.

Continued retraction of the central member 14, as shown in FIG. 8, begins rotation of the pivot member 80 in a counter-clockwise direction by means of the engagement of the edge of cam extension 72 and post 88. That engagement causes a rotation of the camming plate 60 in a clockwise direction such that camming post 88 is seated in the curved recess in extension 72 as shown in FIG. 8. Foot 76 remains in contact with the lower portion of conductor 92 to maintain energization of the solenoid. The operational stroke is completed, as shown in FIG. 9, with camming plate 60 fully rotated clockwise to the left and pivot member 80 fully rotated through 50 degrees in a counter-clockwise direction until stop 96 engages shoulder 98. Foot 76 remains in contact with conductor 92 to maintain the solenoid in operation and central member 14 retracted.

Figure 10:
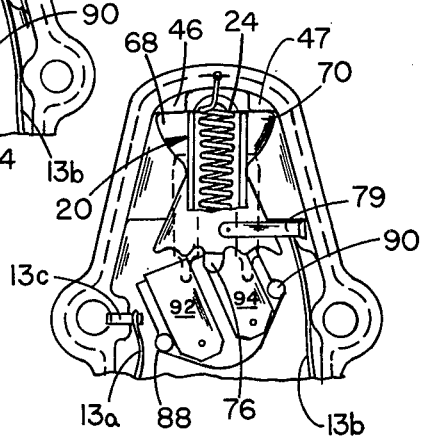
FIG. 10 is a fragmentary plan view of the actuator interior with the plunger returned to the beginning of its reciprocal stroke and the camming plate centered for engagement with the other cam follower post of the pivot member.

When the external switch directing electricity to contact 43 is opened, the circuit to the solenoid is broken and the magnetic force drawing central member 14 into the coil is halted. The biasing force of spring 24 overcomes any residual magnetism and returns the plunger 20, central member 14 attached thereto, and camming plate 60 to the end of the housing. As the plate is brought toward that end, extension 68 engages projection 46 to rotate plate 60 in a counterclockwise direction and return it to its centered position. During that return stroke, the foot 76 of plate 60 slides from conductor 92, across the dielectric strip between conductors 92, 94, and engages conductor 94 as shown in FIG. 10. However, since there is no electrical energy passing through the plate during such sliding movement on the return stroke, no sparking or arcing can occur making the actuator safe for use, even in closed areas. Also, during the return stroke, since camming plate 60 is rotated to the left or clockwise, camming extension 74 moves past the opposite camming post 90 without any engagement thereof.

Figure 11:
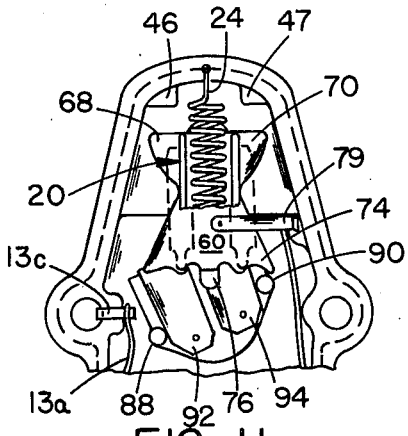
FIG. 11 is a fragmentary plan view of the actuator interior wherein the plunger is in intermediate position during a second reciprocal stroke and the camming plate is in engagement with the other cam follower post of the pivot member to begin rotational movement of the pivot member in the opposite rotational direction.

Once the plunger and camming plate have been returned to the position shown in FIG. 10, an external switch allowing electricity to pass to conductor 41, and thus to conductor 94 via the end 41*a* of the contact member, enables actuation of solenoid 12 to withdraw the plunger, central member and camming plate on a second reciprocal stroke. On this second stroke, since pivot member 80 is rotated to its right-hand position, camming extension 74 engages camming post 90 as shown in FIG. 11, while foot 76 remains in contact with conductor 94. Continued withdrawal of the central member rotates pivot member 80 through 50 degrees in a clockwise direction until stop 96 engages shoulder 97 thereby returning the pivot member to the position shown in FIG. 6. When the external switch to contact 41 is opened, plunger 20 and camming plate 60 are returned and centered leaving the entire apparatus in the position shown in FIG. 6 and ready for successive activation. Accordingly, by operating the actuator through one of two separate electrical circuits contained therein, rotational movement in a desired direction is produced from the reciprocal motion of the plunger and solenoid central member. The pivot member may be actuated for rotational movement in a desired direction only if foot 76 is in contact with the conductor electrically connected to the external switch which is closed.

Figure 13:
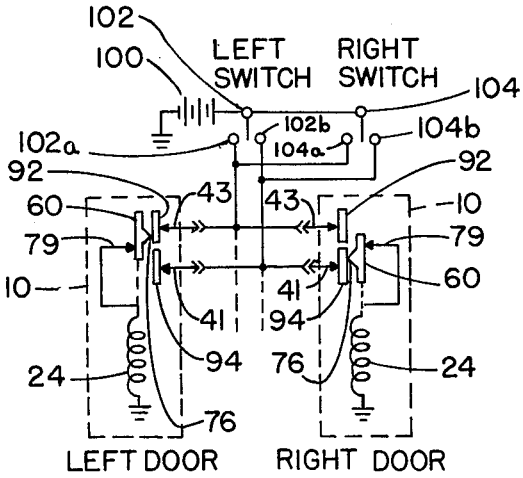
FIG. 13 is a schematic illustration of a preferred electrical circuit in which two of the actuators of the present invention are utilized in a vehicle door lock system.

The above operation is advantageously utilized in a vehicle door lock system which is electrically schematically represented in FIG. 13. It is desirable to automatically lock or unlock two or more doors utilizing an actuator 10 for each door lock mechanism. A source of electrical energy such as a 12 volt d.c. automobile battery is connected through a pair of switches 102, 104 to both of the actuators 10. Such switches may be mounted adjacent driver and passenger positions in a vehicle. Either of the switches 102, 104 will control both actuators simultaneously. If it is desired to lock both doors, switch 102 is thrown into engagement with contact 102*a* causing electricity to be fed through appropriate wiring to contact 43. Assuming that the left door is unlocked while the right door is already locked, electricity flows from contacts 43 through conductors 92. However, since the foot 76 of camming plate 60 is in contact with conductor 92 in only the left door, only the left door solenoid is actuated through contact 79 causing counter-clockwise rotation of the pivot member which locks the left door. The electrical circuit to the solenoid is not completed in the right-hand door since foot 76 of plate 60 in the right-hand door is not contacting conductor 92. When switch contact 102 is released, both doors are locked and both camming plates will be in electrical contact with conductors 94.

Either of switches 102 or 104 may be then activated to contacts 102*b* or 104*b* to open the doors. Electrical energy passes through contact 102*b* or 104*b* to conductors 41, 94, through camming plates 60 and contacts 79 to the solenoids which are activated causing clockwise rotation of the pivot members to unlock the door mechanisms. When the switch is released, camming plates 60 are returned to their centered position with foot 76 being switched to conductors 92 in readiness for actuation to lock the doors the next time.

Hence, only when switch 102 or 104 is thrown in the correct direction will the solenoids be activated. If the switch is thrown to lock the doors and the doors are already locked, pivot member 80 will be in the other rotational position and no electricity will be conducted to the solenoid. If, however, the doors are not locked, throwing the switch in the correct direction will result in their locking. Similarly, only those actuators in the unlocked position will be actuated to the locked position when the switch is thrown in the lock direction. Accordingly, the electrical circuits within the actuator allow operation to produce rotational motion in the desired direction depending on the rotational positon of the pivot member at the beginning of the stroke. Use of the camming plate 60 as both the rotational actuator and the electrical conductor which switches between the two circuits reduces the complexity of the device while providing a durable construction designed for a long life.

While one form of the invention has been shown and described, other forms will now be apparent to those skilled in the art. Therefore, it will be understood that the embodiments shown in the drawings and described above are merely for a illustrative purposes, and are not intended to limit the scope of the invention which is defined by the claims which follow.

The embodiments of the invention in which an exclusive property or privilege is claimed are defined as follows:

1. A selectively activatable actuator for converting linear motion to alternating, opposite direction, rotary motion comprising: operated means for reciprocating said camming member;

said camming member being rotatable about at least a portion of said electrically operated means;

a pivot member and means for rotatably mounting said pivot member;

first and second spaced, cam follower means on said pivot member for alternate engagement with said camming member as said camming member is reciprocated in one direction to rotate said pivot member in opposite directions;

said pivot member including a pair of spaced electrical conductors thereon;

first contact means adapted for connection to a source of electrical energy and for separately electrically contacting each of said electrical conductors at predetermined locations;

said camming member including second contact means for electrically contacting one of said spaced, electrical conductors when said pivot member is rotated in one direction and the other of said conductors when said pivot member is rotated in the opposite direction; and third contact means for electrically connecting said second contact means on said camming member to said electrically operated means whereby separate and distinct electrical circuits are provided through said camming member and pivot member for actuating rotation of said pivot member in a selected direction depending on the rotational position of said pivot member.

2. The actuator of claim 1 wherein said camming member is rotatable in a plane; said pivot member being formed from a dielectric material, having opposite sides, and being rotatable in a plane parallel to the plane of rotation of said camming member; said spaced electrical conductors each extending on opposite sides of said pivot member;

said first contact means including a pair of fixed conductors, one fixed conductor slidably engaging each of said conductors on one side of said pivot member;

said second contact means including a projection on said camming member engaging the opposite side of said pivot member.

3. The actuator of claim 2, wherein said camming member is made from electrically conductive material;

said third contact means including a resilient contact member slidably engaging the surface of said camming member at a position spaced from said projection on said camming means.

4. The actuator of claim 3 wherein said electrically operated means include an electric solenoid having a reciprocable, central member, a plunger rigidly connected to said central member for reciprocation with said central member, and biasing means for returning said central member and plunger to a predetermined position after actuation of said solenoid;

a support for slidably supporting said camming member intermediate said plunger and pivot member;

said plunger including means for rotatably connecting said camming member thereto for reciprocation with said plunger and central member.

5. The actuator of claim 4 wherein said plunger also includes means for slidably engaging and biasing said camming member toward said support and pivot member.

6. The actuator of claim 4, wherein said support is a portion of a housing enclosing said solenoid, plunger, camming member, pivot member, biasing means and at least portions of said first, second and third contact means;

said housing including means for engaging and rotating said camming member to position said camming member for engagement with one of said cam follower means upon return of said plunger and camming member to said predetermined position.

7. The actuator of claim 4 wherein said means for rotatably connecting said camming member to said plunger include a cylindrical post extending through an aperture in said camming member and into a slot in said support;

said slot guiding the reciprocation of said plunger and camming member.

8. The actuator of claim 2 wherein said spaced electrical conductors are U-shaped members formed from electrically conductive material having portions recessed in at least one surface of said pivot member to provide a flush surface on at least one side of said pivot member for contact by said projection on said camming member.

9. The actuator of claim 1 wherein said means for rotatably mounting said pivot member include an axle extending through a support for said pivot member and camming member, said axle adapted to be secured to a bellcrank or the like for actuation of another device; and means for limiting rotational movement of said pivot member.

10. A selectively activatable actuator for converting linear motion to alternating, opposite direction, rotary motion comprising:

a pivot member having a pair of electrical contact members mounted thereon, said contact members being electrically insulated from one another;

means for rotatably mounting said pivot member for rotation in a plane between at least two rotational positions;

reciprocable camming means for alternately rotating said pivot member in opposite rotational directions, said camming means including electrical contact means for engaging one of said electrical contact members in one of said two positions of said pivot member and the other of said two contact members in the other of said two positions of said pivot member whereby two separate and distinct electrical paths are made through said camming means and pivot member depending on the rotational position of said pivot member.

11. The actuator of claim 10 wherein said reciprocable camming means include an electric solenoid having a reciprocable member;

an electrically conductive camming plate rotatably connected to said reciprocable member and reciprocable therewith, said camming plate including a contact for slidably engaging one or the other of said contact members on said pivot member;

first means for electrically connecting a source of electricity of said contact members on said pivot member;

second means for electrically connecting said solenoid to said camming plate;

and first and second cam followers at spaced locations on said pivot member for alternate engagement with said camming plate to rotate said pivot member in opposite directions as said camming plate and reciprocable member are reciprocated toward said pivot member whereby said electric solenoid is selectively actuatable through said electrical paths for rotation of said pivot member in a desired rotational direction depending on the rotational position of said pivot member.

12. The actuator of claim 11 wherein said separate electrical contact members each extend on opposite surfaces of said pivot member;

said first means including separate contact means for slidably engaging each of said contact members on one surface of said pivot member;

said camming plate contact engaging one or the other of said contact members on the surfaces of said pivot member opposite said one surface.

13. The actuator of claim 12 wherein said separate contact members are released in at least said opposite surface of said pivot member such that said contact members are flush with portions of said opposite surface of said pivot member to provide a smooth sliding surface for engagement with said camming plate contact.

14. An actuator for converting linear motion to alternating, opposite direction, rotary motion comprising a housing; a plunger within said housing;

means for reciprocating said plunger between first and second positions;

a camming plate slidably supported on said housing and adjacent said plunger;

means for rotatably connecting said camming plate to said plunger, said camming plate being reciprocable with said plunger;

a pivot member spaced from said camming plate and means for rotatably mounting said pivot member with respect to said housing;

first and second cam follower means spaced apart on said pivot member for engaging said camming plate when said plunger and camming plate are reciprocated toward said second position and said pivot member;

said camming plate being rotatable by engagement with said cam follower means between a first position for engaging one of said first and second cam follower means but not the other to pivot said pivot member in one direction, and a second position for contacting the other of said cam follower means but not said one cam follower means to pivot said pivot member in a direction opposite to said one direction whereby said pivot member is rotated in opposite directions depending upon the relative positions of said first and second cam follower means;

engaging means on said housing for engaging said camming plate and rotating said camming plate to a third position when said plunger and camming plate are returned to their first position thereby enabling contact by said camming plate with either of one of said cam follower means depending upon the relative positions of said first and second cam follower means.

15. The actuator of claim 14 wherein said camming plate is intermediate said plunger and pivot member;

said plunger including means for biasing said camming plate against said housing and toward said pivot member.

16. The actuator of claim 15 wherein said housing includes said means for rotatably mounting said pivot member at one position;

said housing including a surface for slidably supporting said camming plate which surface is located at a position offset from said one housing position.

17. The actuator of claim 15 wherein said plunger is a channel-shaped member;

said means for reciprocating said plunger including a spring received within said channel-shaped plunger;

said means for biasing said camming plate including an elongated arm attached in cantilevered fashion to one side of said plunger, said arm being intermediate said plunger and camming plate.

18. The actuator of claim 17 wherein said means for reciprocating said plunger also include an electric solenoid having a reciprocable, central member;

said plunger being rigidly connected to said central member.

19. The actuator of claim 14 wherein said means for reciprocating said plunger include an electric solenoid having a reciprocable, central member to which said plunger is rigidly connected and a spring biasing said plunger away from said solenoid;

said plunger being pulled against the biasing force of said spring by said solenoid when said solenoid is activated and energized.

20. The actuator of claim 19 wherein said plunger is an elongated channel member;

said spring being received within said channel member, having one end secured within said channel member, and its opposite end secured to said housing opposite said solenoid.

21. The actuator of claim 19 wherein said camming plate is made from electrically conductive material;

said pivot member, plunger and housing being made from non-conductive, dielectric material;

said pivot member including first and second spaced, electrical conductors;

said camming plate having a projecting portion engaging the surface of said pivot member for electrical contact with one or the other of said conductors;

a third conductor engaging said camming plate;

a fourth conductor movably and continuously engaging said first conductor and a fifth conductor movably and continuously engaging said second conductor, said fourth and fifth conductors adapted for connection to a source of electrical energy;

said camming plate projection portion electrically contacting said first conductor when said pivot member is rotated in one direction and said second conductor when said pivot member is rotated in the opposite direction whereby the circuits to said solenoid are separate and distinct for selective operation of said actuator when said pivot member is rotated in a predetermined direction.

22. The actuator of claim 21 wherein said first and second conductors each extend on opposite surfaces of said pivot member;

said fourth and fifth conductors being fixed and respectively contacting said first and second conductors on one surface of said pivot member;

said projecting portion of said camming plate contacting said pivot member on the surface opposite said one surface;

said third conductor being an electrically conductive spring member which constantly but movably engages said camming plate as it is reciprocated and rotated.

23. The actuator of claim 21 including biasing means on said plunger for continuously engaging said camming plate and biasing it toward said pivot member and against said housing to maintain electrical contact of said projecting portion with one of said first and second conductors.

24. The actuator of claim 14 wherein said means for rotatably mounting said pivot member include an axle extending through said housing from one side of said pivot member;

said camming plate being generally planar;

said pivot member axle being transverse to said plane of said camming plate such that said pivot member rotates in a plane parallel to that of said camming plate;

said first and second cam follower means including first and second spaced posts, one post located adjacent each lateral edge of said pivot member, said posts extending from the side of said pivot member opposite said one side from which said axle extends.

25. The actuator of claim 24 wherein said camming plate includes first and second lateral extensions having curved, camming edge surfaces for engaging said posts alternately to rotate said pivot member in alternate directions.

26. The actuator of claim 14 wherein said engaging means includes a pair of spaced projections on the interior of said housing in opposition to said camming plate;

said camming plate including third and fourth spaced lateral extensions at the end of said camming plate opposite said first and second extensions, said third and fourth lateral extensions alternately engaging one or the other of said pair of projections as said plunger is returned to its first position whereby said camming plate is alternately rotated in opposite directions to said third positon.

27. The actuator of claim 14 wherein said means for reciprocating said plunger include an electric solenoid having a reciprocable central member formed from ferromagnetic material within a central opening in a coil of wire, said coil of wire being surrounded by a continuous metallic frame having a conical core extending into one end of said central opening, said central member having a conical recess adapted to mate with and receive said conical core when said coil of wire conducts electricity therethrough and said central member is magnetically drawn into said central opening.

* * * * *

UNITED STATES PATENT AND TRADEMARK OFFICE

CERTIFICATE OF CORRECTION

PATENT NO. : 4,142,167

DATED : February 27, 1979

INVENTOR(S) : Little, et al.

It is certified that error appears in the above-identified patent and that said Letters Patent are hereby corrected as shown below:

Column 9, line 6:

"comprising: operated means for reciprocating said camming member;" should be

--comprising:

a camming member and electrically operated means for reciprocating said camming member;--;

Column 10, line 65:

"of" should be --to--;

Column 11, line 21:

"released" should be --recessed--;

UNITED STATES PATENT AND TRADEMARK OFFICE

CERTIFICATE OF CORRECTION

PATENT NO. : 4,142,167 Page 2 of 2

DATED : February 27, 1979

INVENTOR(S) : Little, et al.

It is certified that error appears in the above-identified patent and that said Letters Patent are hereby corrected as shown below:

Column 14, line 5:

"includes" should be --include--

Signed and Sealed this

*Twenty-fifth* Day of *September 1979*

[SEAL]

*Attest:*

LUTRELLE F. PARKER

*Attesting Officer* *Acting Commissioner of Patents and Trademarks*